US010507572B2

(12) United States Patent
Williams

(10) Patent No.: US 10,507,572 B2
(45) Date of Patent: Dec. 17, 2019

(54) WORKBENCH

(71) Applicant: Gareth Williams, Berkshire (GB)

(72) Inventor: Gareth Williams, Berkshire (GB)

( * ) Notice: Subject to any disclaimer, the term of this patent is extended or adjusted under 35 U.S.C. 154(b) by 358 days.

(21) Appl. No.: 15/450,433

(22) Filed: Mar. 6, 2017

(65) Prior Publication Data

US 2017/0252917 A1 Sep. 7, 2017

(30) Foreign Application Priority Data

Mar. 7, 2016 (GB) ..... 1603863

(51) Int. Cl.

| | |
|---|---|
| ***B25H 1/14*** | (2006.01) |
| ***B25H 1/02*** | (2006.01) |
| ***B25H 1/06*** | (2006.01) |
| ***B25H 1/08*** | (2006.01) |

(52) U.S. Cl.

CPC ..... *B25H 1/14* (2013.01); *B25H 1/02* (2013.01); *B25H 1/06* (2013.01); *B25H 1/08* (2013.01)

(58) Field of Classification Search

CPC ... B25H 1/02; B25H 1/04; B25H 1/14; B25H 1/06; B25H 1/08

USPC ..... 108/153.1, 154, 155, 156, 159.1

See application file for complete search history.

(56) References Cited

U.S. PATENT DOCUMENTS

| | | | | |
|---|---|---|---|---|
| 2,889,177 A | | 6/1959 | Rambow | |
| 5,535,847 A | * | 7/1996 | DuRapau | B25H 1/04 108/157.1 |
| 7,275,289 B2 | * | 10/2007 | Lipniarski | A47C 5/12 108/101 |
| 8,997,930 B2 | * | 4/2015 | Moss | B25H 1/06 182/129 |
| 2010/0038332 A1 | * | 2/2010 | Ignatoff | B25H 1/06 211/201 |
| 2010/0156017 A1 | * | 6/2010 | Zhang | B25H 1/04 269/289 R |
| 2011/0155506 A1 | * | 6/2011 | Caple | B25H 1/06 182/153 |
| 2014/0231602 A1 | * | 8/2014 | Lifshitz | F16M 11/04 248/165 |
| 2016/0346912 A1 | * | 12/2016 | Reinhart | B25H 1/06 |
| 2017/0173778 A1 | * | 6/2017 | Reinhart | B25H 1/06 |
| 2018/0085912 A1 | * | 3/2018 | Cindric | B25H 1/04 |

(Continued)

FOREIGN PATENT DOCUMENTS

| | | |
|---|---|---|
| CN | 204819421 | 12/2005 |
| FR | 2418062 | 9/1979 |

(Continued)

*Primary Examiner* — Daniel J Rohrhoff

(74) *Attorney, Agent, or Firm* — Law Offices of Steven W. Weinrieb

(57) ABSTRACT

A workbench comprising a first support, a second support and a first work surface, in which said first support comprises a leg structure with an upper end, in which said first work surface comprises a first end, in which said upper end and said first end comprise a connection means to releasably connect them together, and in which said connection means comprises a first pair of parallel elongate troughs provided on either said upper end or said first end, and a first pair of parallel elongate flanges provided on the other of said upper end or said first end, which first pair of flanges is shaped and configured to be releasably engagable in said first pair of troughs.

16 Claims, 5 Drawing Sheets

(56) References Cited

U.S. PATENT DOCUMENTS

| | | | | |
|---|---|---|---|---|
| 2018/0099403 | A1* | 4/2018 | Reinhart | B25H 1/005 |
| 2018/0290289 | A1* | 10/2018 | Reinhart | B25H 1/12 |
| 2018/0291685 | A1* | 10/2018 | Moreno | E06C 7/14 |

FOREIGN PATENT DOCUMENTS

| | | |
|---|---|---|
| GB | 2419085 | 4/2006 |
| WO | 2010/129703 | 11/2010 |

* cited by examiner

WORKBENCH

The present invention relates to a workbench, for use particularly, but not exclusively, for supporting machine tools and workmen's equipment.

There are many known kinds of workbench, which comprise a supporting frame which carries a work surface. In many cases such workbenches are reconfigurable to suit different work requirements, or collapsible to make them easier to transport and store. This may include having a removable work surface, and collapsible legs or support frames.

However, known designs of reconfigurable or collapsible workbenches suffer from a number of drawbacks. In particular, if the work surface is removably mounted to legs or a support frame, the interface between these components can be weak, which can be dangerous. Known mounting mechanisms can fail too easily if a work surface is placed under heavy strain, or is knocked sideways. This can lead to instability, or total collapse.

Further, known mechanisms are limited in their range of operational configurations. Some can be raised or lowered, and others have work surfaces which can be extended laterally. However, the range of movement is usually fairly small. It is also possible to place two or more known workbenches alongside one another to create a larger work surface, but as they are not connected together securely this is not ideal.

The present invention is intended to overcome some of the above described problems.

Therefore, according to the present invention a workbench comprises a first support, a second support and a first work surface, in which said first support comprises a leg structure with an upper end, in which said first work surface comprises a first end, in which said upper end and said first end comprise a connection means to releasably connect them together, and in which said connection means comprises a first pair of parallel elongate troughs provided on either said upper end or said first end, and a first pair of parallel elongate flanges provided on the other of said upper end or said first end, which first pair of flanges is shaped and configured to be releasably engagable in said first pair of troughs.

Thus, in its simplest form the present invention provides a secure mechanism to releasably attach a work surface to a support. This is achieved with the first pair of flanges and the corresponding first pair of troughs into which they fit. The elongate nature of the flanges, and the fact that there are two in parallel, provides a beneficial way to spread loading applied in use. In particular, any lateral loading applied to the first end of the work surface, which might result from weight carried by the work surface away from the first end, or from any twisting forces applied to the work surface in relation to the first support, is adequately compensated for by the large area of the flanges. This parallel flange configuration also provides a redundancy should one of the flanges fail under loading in use.

It will be appreciated that the invention includes both an arrangement in which the first pair of troughs are provided on the upper end of the first support and the first pair of flanges are provided on the first end of the first work surface, and the opposite arrangement in which the first pair of troughs are provided on the first end of the first work surface and the first pair of flanges are provided on the upper end of the first support. In the former arrangement the troughs will be facing upwards and the flanges downwards, and in the latter arrangement the opposite will be the case. The invention can work just as well either way. In the following description the former arrangement is shown for the connection means and for each of several further equivalent connection means employed elsewhere on the workbench. In every case the opposite latter arrangement could be used instead, and the invention covers such alternative embodiments.

Therefore, in a preferred construction the upper end of the first support can comprise the first pair of troughs and the first end of the first work surface can comprise the first pair of flanges.

Preferably the second support can comprise a leg structure provided with a second pair of parallel elongate troughs at an upper end thereof, and the first work surface can comprise a second end comprising a second pair of parallel elongate flanges which are shaped and configured to be releasably engagable in the second pair of troughs. Therefore, the same arrangement as provided at the first end of the work surface is provided at its second end. As such, the invention provides a workbench which is stable, secure and capable of withstanding significant loading at both ends, and which can very easily be constructed and dismantled.

It will be appreciated that the troughs of the first and second pairs of troughs can have any cross-sectional shape, such as a square, rectangular or triangular shape, or any polygonal combination of such shapes. However, in a preferred construction each trough of each of the first and second pairs of troughs can comprise a cross-sectional shape comprising a receiving opening, a first section, a second section and a base, in which the first section tapers inwardly from the receiving opening to the second section, in which the second section has a constant width from the first section to the base, in which the base comprises a rounded shape, and in which each flange of each of the first and second pairs of flanges can comprise a cross-sectional shape comprising a third section, a fourth section and an end which correspond in shape to the first section, second section and base respectively of each trough of each of the first and second pairs of troughs.

With this shape the receiving opening of each trough is wider than the width of the fourth section of each flange, which makes it easy to initially locate a flange in a trough, and the first section of each trough also tapers inwardly which helps to guide each flange into the correct position. The rounded end of each flange also facilitates ready initial location of a flange into a trough, as well as a smooth movement thereof to the fully engaged position. In fact, if an end of a flange is placed anywhere on the first section of a trough, the end will ride over the first section until it is aligned with the second section thereof, and the flange will then drop into the fully engaged position. It will be appreciated that as the first and second pairs of flanges, as well as the first and second pairs of troughs, are parallel, each of a pair of flanges will locate simultaneously in the same way in each of a corresponding pair of troughs. (If the flanges and troughs are oriented the other way up in alternative arrangements like those mentioned above, the same smooth coming together of the parts will occur, only with the troughs dropping into place on the flanges.)

In one construction the first support can be provided with a retention member at each end of each trough of the first pair or troughs, and likewise the second support can be provided with a retention member at each end of each trough of the second pair of troughs. The first work surface can comprise a retention clip at each end of each flange of each of the first and second pairs of flanges, each of which retention clips releasably retaining one of the retention members. This feature provides a means to retain the first and second pairs of flanges in the fully engaged position, and it also provides a means to prevent the first and second pairs of flanges from axially sliding out from the first and second pairs of troughs respectively. As such, the first work surface is secured against planar movement in any direction.

The leg structures can be any known kind of upstanding support capable of comprising a pair of parallel elongate troughs or flanges at an upper end thereof. However, in a preferred construction each of the leg structures can comprise a pair of parallel collapsible A-frames with a first spar extending between tops of corresponding first arms of the pair of A-frames and a second spar extending between tops of corresponding second arms of the pair of A-frames, the first arms being hinged to the second arms. Both of the first and second pairs of troughs can comprise one trough formed on a first spar and one trough formed on a second spar.

This construction is beneficial because a construction made up of pair of spaced apart parallel A-frames is a solid and stable support platform which is capable of supporting heavy loads as well as being highly resistant to toppling. It is also very easy to collapse for storage and transportation because the arms of each A-frame can simply be brought together via hinged rotation therebetween. It will be appreciated that with both of the first and second pairs of troughs comprising one trough formed on a first spar and one trough formed on a second spar, collapsing of the A-frames will involve rotation of the two troughs of the first or second pair of troughs away from one another. Therefore, location of the first or second pair of flanges in the first or second pair of troughs locks the A-frames in question in their unfurled position, because the two troughs of the first or second pair of troughs are prevented from rotating away from one another. As such, when the first work surface is engaged on the first and second supports a highly rigid and stable table-like structure is formed, with a locked A-frame leg at each corner.

The above described arrangement also allows for a modular system of interlocking first work surfaces. In particular, if an additional first work surface and first or second support is provided, then a workbench can be constructed with three supports in a line, and two first work surfaces mounted in the spaces between them. The above described features specifically allow for this. In particular, at the middle of the three supports an outermost flange of the pair of flanges at the end of one work surface can be releasably engaged in one of the pair of troughs provided by the middle support, and an outermost flange of the pair of flanges at the end of the other work surface can be releasably engaged in the other of the pair of troughs provided by the middle support. Therefore, the feature of a pair of parallel troughs specifically allows for a support of the invention to carry two adjacent work surfaces at once. It will be appreciated that there is no limit to the number of supports and work surfaces which could be erected in a line in this manner.

In order to provide even greater flexibility, the invention also includes another type of leg structure. In particular, in one embodiment the first work surface can comprise a second end comprising a hinge, and the second support can comprise a leg structure rotatably mounted to the hinge. With this construction a simpler and lighter folding leg structure is provided at the second end of the work surface.

However, the present invention also includes a combination of the two above described work surface designs. In particular the workbench can comprise a second work surface comprising a first end comprising a third pair of parallel elongate flanges, which are shaped and configured to be releasably engagable in the first pair of troughs. The second work surface can then comprise a second end comprising a hinge, and a third support can comprise a leg structure rotatably mounted to the hinge.

With this set of features a workbench is provided which comprises two adjacent work surfaces, one end of which has the simpler and lighter folding leg structure. Such an arrangement might be convenient if space is limited, or if it is desired to have an end of a multiple work surface configuration with a leg structure which does not extend beyond the end of the work surface. To erect this structure the first and second supports are used support the first work surface but with the outermost flange of the first or second pair of flanges releasably engaged in just one of the corresponding first or second pair of troughs, and with the second work surface arranged adjacent to the first work surface, with the outermost flange of the third pair of parallel flanges releasably engaged in the other of the first or second pair of troughs in question. Once again, the feature of a pair of parallel troughs specifically allows for a support to carry two adjacent work surfaces at once, this time with the two work surfaces having different support designs at their other ends.

It is important when two work surfaces are erected adjacent one another in any of the above described configurations that no gap exists between them. In order to ensure this does not happen, the first pair of flanges can be spaced apart from the first end by a distance which is substantially half a distance the first pair of flanges are spaced apart from one another. The same spacing arrangement can exist for the second end and the second pair of flanges, as well as for the first end of the second work surface and the third pair of flanges. Therefore, when the ends of two work surfaces are placed next to one another, the outermost flanges of the two adjacent pairs of flanges in question are the correct spacing apart from one another to fit into the pair of troughs in question.

In order to provided yet further flexibility, the first work surface can comprise a first edge extending between the first end and the second end. The first edge can comprise an elongate trough shaped and configured to receive a flange of the same shape as any flange of the first or second pair of flanges.

With this arrangement another kind of multiple work surface construction can be erected, and in particular one in which an additional first work surface (or a second work surface) can be arranged perpendicular to the initial first work surface. This allows for a modular workbench with an L-shaped arrangement of work surfaces to be erected.

The workbench can also comprise a work tray, and the first support can comprise a first elongate laterally facing slot at the upper end thereof. The work tray can comprise a first end comprising an elongate key which is shaped and configured to be releasably engagable in the first slot. These additional features allow a work tray to be fitted to the first support to provide a place for a worker to conveniently place tools and other items.

Preferably the first support can comprise a second elongate laterally facing slot at the upper end thereof, which second slot faces in the opposite direction to first slot. This allows the work tray to be fitted to either side of the upper end of the first support.

It will be appreciated that the same arrangement can be provided on the second support to allow the work tray to be fitted in multiple different places as required. Therefore in an alternative arrangement the workbench can comprise a work tray, the first support can comprise a first elongate laterally facing slot and a second elongate laterally facing slot at the upper end thereof, which second slot faces in the opposite direction to the first slot, and the second support can comprise a third elongate laterally facing slot and a fourth elongate laterally facing slot at the upper end thereof, which fourth slot faces in the opposite direction to the third slot. The work tray can comprise a first end comprising an elongate key which is shaped and configured to be releasably engagable in any of the first, second, third or fourth slots.

Preferably the work tray can comprise a support post extending from an underside thereof, which support post can be releasably connectable to the first support or the second support, at a mid-point below the upper end thereof. This provides an additional level of support for the work tray.

The invention can be performed in various ways, but one embodiment will now be described by way of example, and with reference to the accompanying drawings, in which.

Figure 1:
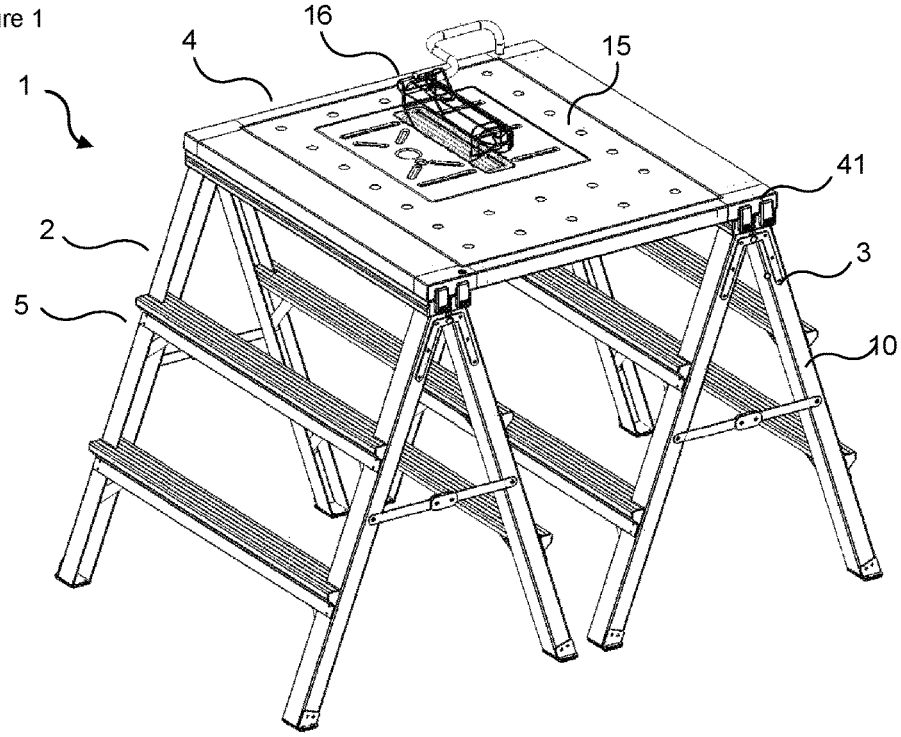
FIG. 1 is a perspective view of a workbench according to the present invention in a first configuration.
Figure 2:
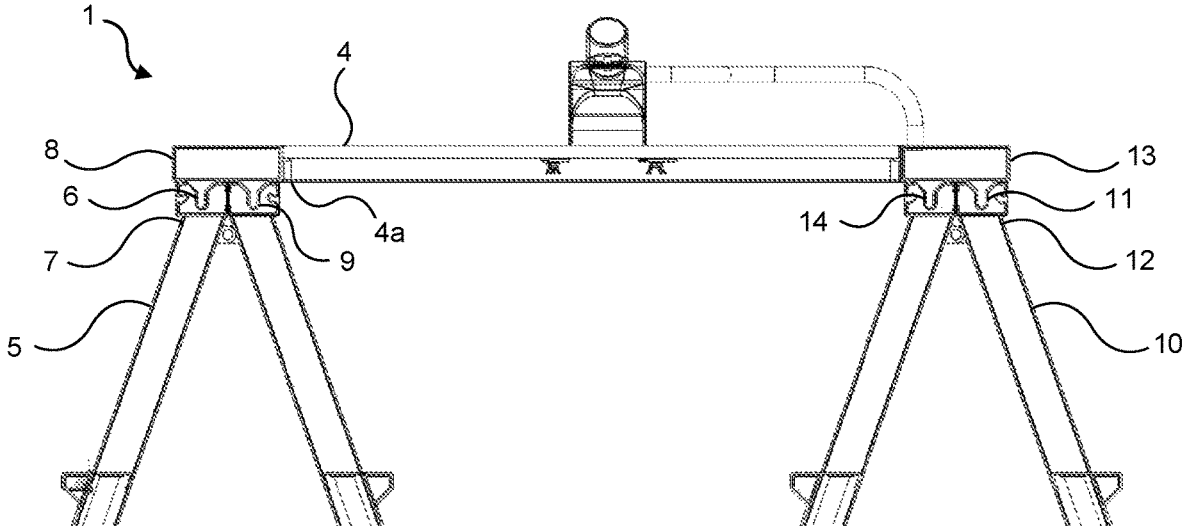
FIG. 2 is a partial cross-sectional side view of the workbench as shown in FIG. 1.

As shown in FIGS. 1 and 2 a workbench 1 comprises a first support 2, a second support 3 and a first work surface member 4, in which the first support 2 comprises a leg structure 5 provided with a first pair of parallel elongate troughs 6 at an upper end 7 thereof, in which the first work surface member 4 comprises a first pair of parallel elongate flanges 9 provided upon an underside 4*a* thereof adjacent to a first end 8, which first pair of flanges 9 is shaped and configured to be releasably engagable in the first pair of troughs 6.

It will be appreciated that the location of the first pair of troughs 6 and the first pair of flanges 9 in workbench 1 is only one of the possible connection means configurations of claim 1 below, and that claim 1 also included the alternative opposite arrangement of connection means in which the first pair of flanges are provided upon the upper end 7 of the first support 2 and the first pair of troughs are provided upon the underside 4*a* adjacent to the first end 8 of the first work surface member 4. Such an arrangement is not shown herein, but it is included in the scope of claim 1. Furthermore, this alternative opposite arrangement can also be used for each of the several further equivalent connection means employed elsewhere on the workbench 1, which are described in greater detail.

The second support 3 also comprises a leg structure 10 provided with a second pair of parallel elongate troughs 11 at an upper end thereof 12, and the first work surface member 4 comprises a second pair of parallel elongate flanges 14 provided on the underside 4*a* thereof adjacent to a second end 13 which are shaped and configured to be releasably engagable in the second pair of troughs 11.

The first work surface 4 is a planar platform intended to support a variety of work tools or machines. It is provided with a plurality of mounting slots 15 or varying shapes and sizes, which can support various known items, such as electrical saw 16 as shown, in any known way. It can also be used to support any free standing items, such as work tools, painting and decorating materials, or even a person. It is obviously important that the first work surface 4 is supported in a substantially horizontal plane for use, as shown.

Figure 3:
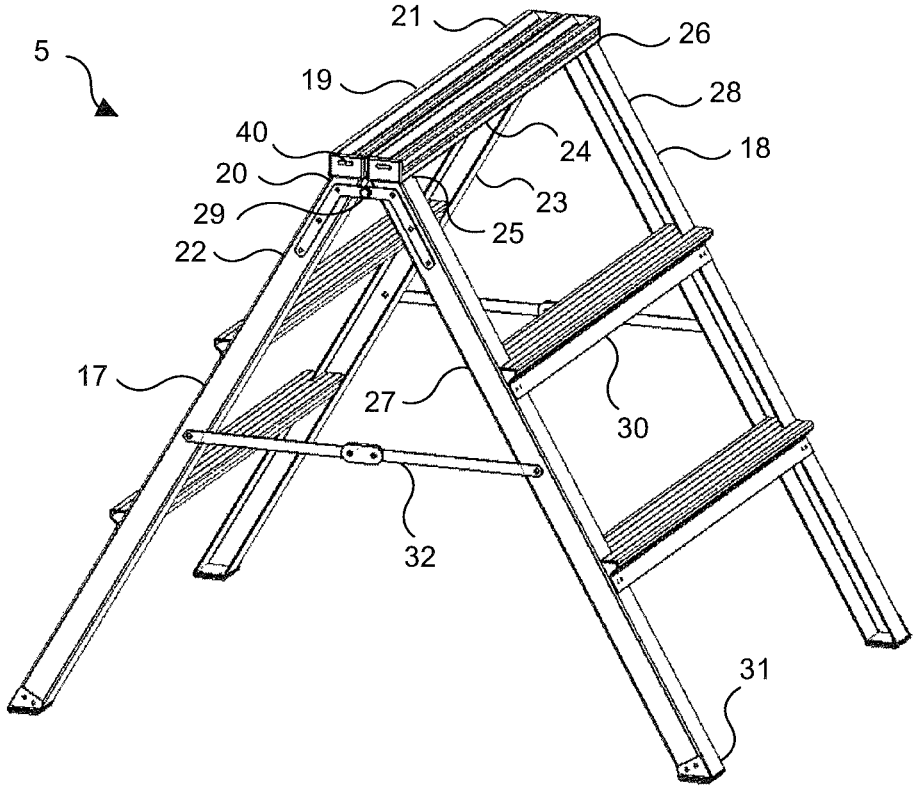
FIG. 3 is a perspective view of a first support of the workbench as shown in FIG. 1.

The first and second leg structures 5 and 10 are identical, and as such the same reference numeral are used to refer to identical features. Referring to FIG. 3, which shows the first leg structure 5 in isolation, in each case the leg structures 5 and 10 comprise a pair of parallel collapsible A-frames 17 and 18 with a first spar 19 extending between tops 20 and 21 of corresponding first arms 22 and 23, and a second spar 24 extending between tops 25 and 26 of corresponding second arms 27 and 28. The first arms 22 and 23 are hinged to the second arms 27 and 28 by hinge 29, just below the spars 19 and 24.

In other respects the leg structures 5 and 10 are similar in construction to known step ladders, in that they also comprise step spars 30, feet 31 and collapsible support brackets 32. The leg structures 5 and 10 can be moved between an unfurled position as shown in FIG. 3, and a collapsed position in which the first arms 22 and 23 are brought alongside the respective second arms 27 and 28 via rotation about the hinge 29. The support brackets 32 act to delimit the extent of rotation of the hinge 29, and therefore define the angle of the first arms 22 and 23 in relation to the second arms 27 and 28 in the unfurled position. The support brackets 32 are folded in half in the collapsed position.

Figure 4:
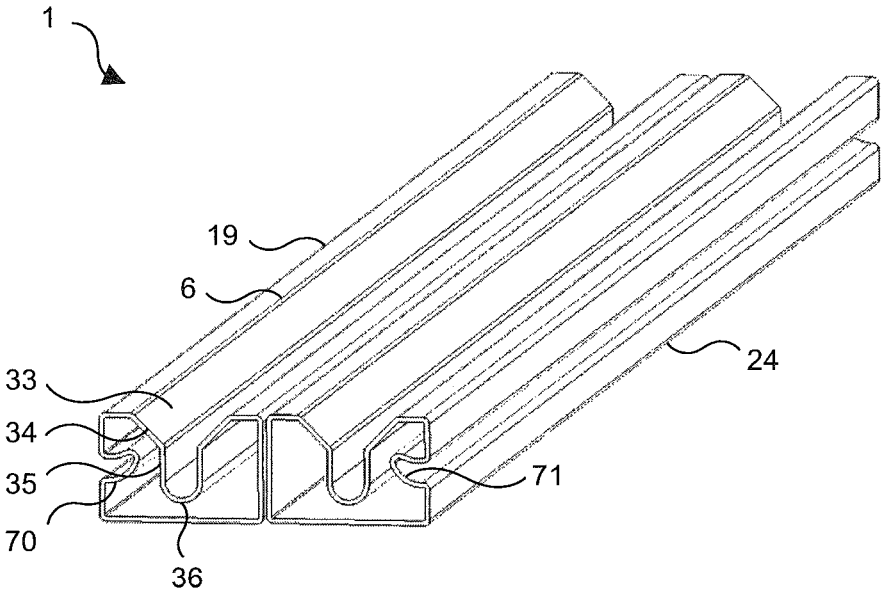
FIG. 4 is a partial perspective view of first and second spars of the first support shown in FIG. 3.

FIG. 4 shows a section of the first and second spars 19 and 24, which collectively define the first pair of parallel elongate troughs 6. As is clear from FIG. 4, each trough of the pair of troughs 6 comprises a cross-sectional shape comprising a receiving opening 33, a first section 34, a second section 35 and a base 36. The first section 34 tapers inwardly from the receiving opening 33 to the second section 35. The second section 35 then has a constant width from the first section 34 to the base 36. The base 36 comprises a rounded shape. As is clear from FIG. 4 the first and second spars 19 and 24 have this cross sectional shape in a uniform manner along their length. The second pair of toughs 11 are identical in shape to the first pair of troughs 6 shown in FIG. 4.

Figure 6:
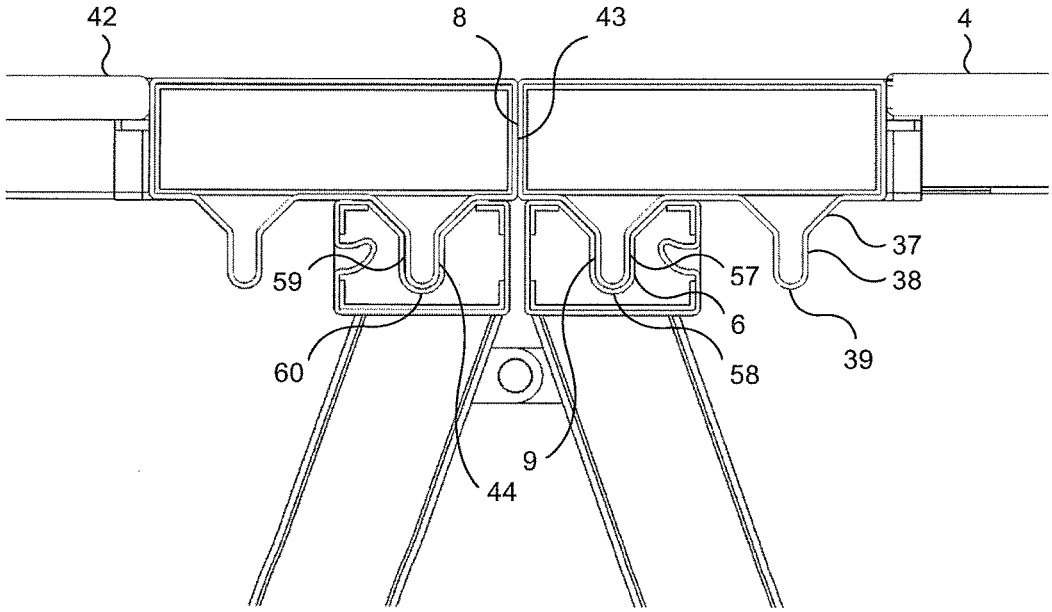
FIG. 6 is a partial cross-sectional side view of the workbench shown in FIG. 5.

Each flange of the first and second pairs of flanges 9 and 14 comprises a cross-sectional shape which corresponds to that of the troughs of the first pair of troughs shown in FIG. 4. This is best seen in FIG. 6, which is described in greater detail below. However, as can be seen from FIG. 6, each flange of the first pair of flanges 9 comprises a third section 37, a fourth section 38 and an end 39 which correspond in shape to the first section 34, second section 35 and base 36 respectively of each trough of the first and second pairs of troughs 6 and 11.

It will be appreciated that with this shape of trough and flange the receiving opening 33 is wider than the fourth section 38, which makes it easy to initially locate a flange in a trough. Further, because the first section 34 tapers inwardly this helps to guide the flange into the correct alignment position with the respective trough. The rounded end 39 of a flange also facilitates ready initial location of a flange into a trough as well as a smooth movement thereof to the fully engaged position. In fact, if an end 39 of a flange is placed anywhere on the first section 34, the end 39 will ride over the first section 34 until it is aligned with the second section 35, and the flange will then drop into the fully engaged position. It will be appreciated that as each of the first and second pairs of flanges 9 and 14, as well as each of the first and second pairs of troughs 6 and 11, are parallel, each of a pair of flanges will locate simultaneously in the same way in a corresponding pair of troughs. (If the flanges and troughs are oriented the other way up in alternative arrangements like those mentioned above, the same smooth coming together of the parts will occur, only with the troughs dropping into place on the flanges.)

Referring back to FIG. 3, it is clear that the first pair of troughs 6 comprise one trough formed on the first spar 19 and one trough formed on the second spar 24. It will be appreciated therefore that the first pair of troughs 6 are only formed when the leg structure 5 is placed in the unfurled position shown. Further, when the leg structure 5 is moved from the unfurled position to the collapsed position, as described above, the two troughs of the first pair of troughs 6 rotate away from one another. Therefore, engagement of the first pair of flanges 9 in the first pair of troughs 6, as shown in FIGS. 1 and 2, locks leg structure 5 in the unfurled position, because the two troughs of the first pair of troughs 6 are prevented from rotating away from one another.

The leg structure 5 is provided with a retention member at each end of each trough of the first pair or troughs 6, in the form of tabs 40. The same feature is provided on the other leg structure 10. As shown in FIG. 1 the first work surface 4 comprises a retention clip 41 at each end of each flange of each of the first and second pairs of flanges 9 and 14, each of which releasably retains one of the tabs 40. The retention clips 41 provide a means to retain the first and second pairs of flanges 9 and 14 in the fully engaged position in the first and second pairs of troughs 6 and 11, and therefore the first work surface 4 to the leg structures 5 and 10. This also acts to maintain the leg structures 5 and 10 in the unfurled position. Therefore, if the first work surface 4 is inadvertently lifted in use it will not disconnect from the leg structures 5 and 10, and if the leg structures 5 and 10 are also lifted, they will not move to their collapsed positions. Therefore, once the retention clips 41 are applied, the workbench 1 assumes a robust and stable structure which is resistant to collapsing.

Furthermore, the retention clips 41 also provide a means to prevent the first and second pairs of flanges 9 and 14 from axially sliding out from the first and second pair of troughs 6 and 11 respectively. As such, the first work surface 4 is also secured against planar movement in any direction.

Figure 5:
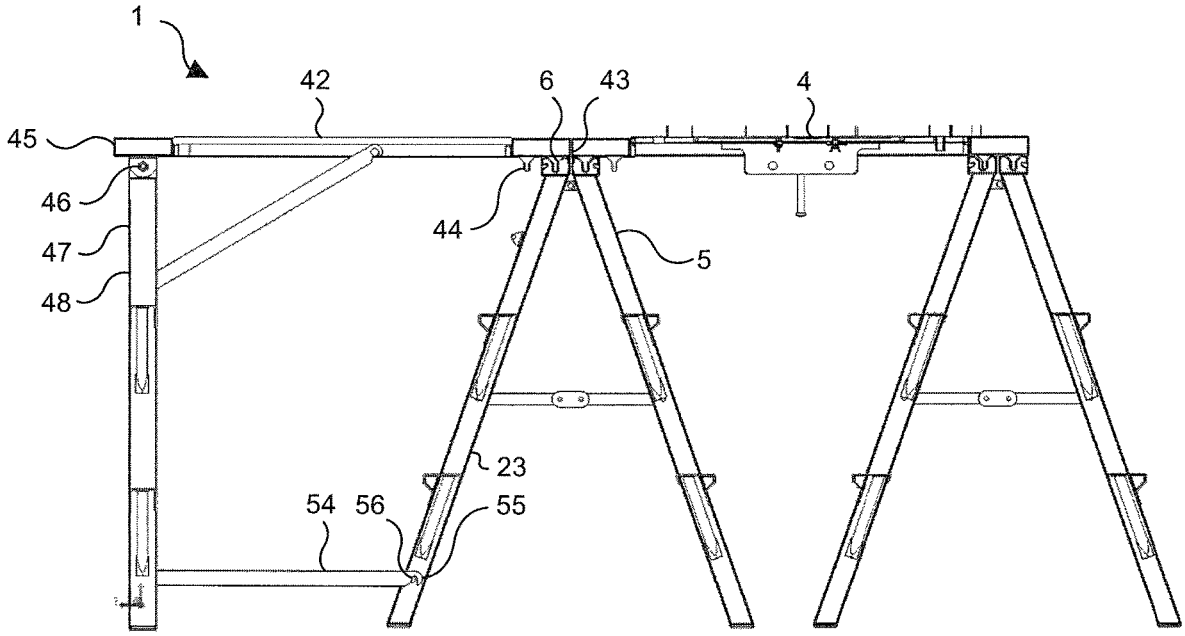
FIG. 5 is a cross-sectional side view of the workbench shown in FIG. 1 in a second configuration.

The workbench 1 comprises a number of further components to enhance its usability. In particular, as shown in FIG. 5, the workbench 1 further comprises a second work surface 42 comprising a first end 43 comprising a third pair of parallel elongate flanges 44, which are shaped and configured to be releasably engagable in the first pair of parallel troughs 6. The second work surface 42 comprises a second end 45 comprising a hinge 46, and a third support 47, which comprises a leg structure 48 rotatably mounted to the hinge 46.

The second work surface 42 is shown clearly in FIG. 7, which is described in greater detail below. However, as can be seen from FIG. 7, the second work surface 42 is a similar planar platform to the first work surface 4, and is also intended to support a variety of work tools or machines. It is provided with a plurality of mounting slots 47, which can support various known items. It can also be used to support any free standing items, such as work tools or painting and decorating materials. It is obviously important that the second work surface 42 is supported in a substantially horizontal plane for use, as shown in FIG. 7.

The leg structure 48 comprises a square frame made up of a pair of parallel legs 49 and 50 with three spars 51 extending between them. These spars 51 are provided with angled braces 52. First support brackets 53 extend between the legs 49 and 50 and the second work surface 49, and delimit the range of rotational movement of the leg structure 48 about the hinge 46. Further, second support brackets 54 extend between each leg 49 and 50 of the leg structure 48 and the corresponding first arms 22 and 23 of A-frames 17 and 18 of the leg structure 5. As is clear from FIG. 5, the second support brackets 54 comprise a latch 55 which engages a keeper 56 on the corresponding first arm 22 or 23. Therefore, the second support brackets 54 serve to prevent the leg structure 48 from being moved laterally away from the leg structure 5. Each second support bracket 54 is mounted on a hinge 54' provided on the respective leg 49 or 50, so it can be rotated.

Figure 7:
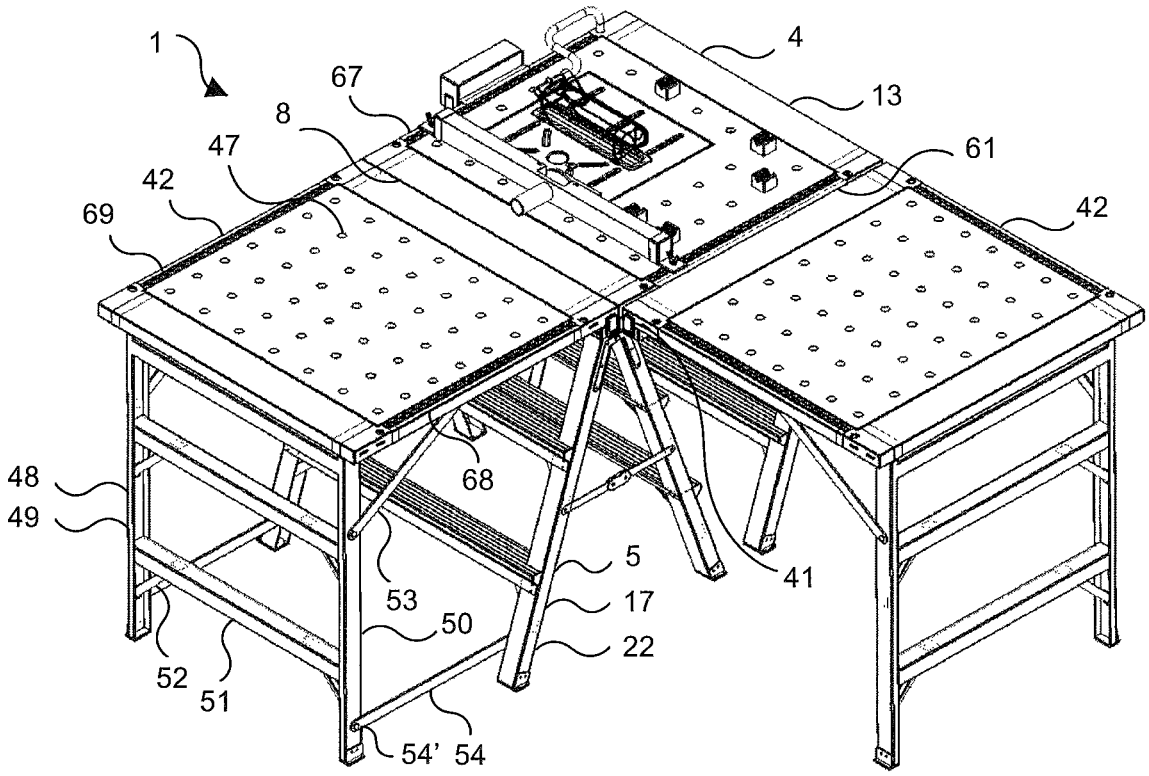
FIG. 7 is a perspective view of the workbench shown in FIG. 1 in a third configuration.

The second work surface 42 can be moved between an unfurled position as shown in FIGS. 5 and 7, and a collapsed position in which the leg structure 48 is rotated about the hinge 46 until it is parallel with the work surface 42. The second support brackets 54 are rotated about their respective hinges 54' until they are parallel with the respective leg 49 or 50.

Referring now to FIG. 6, it will be appreciated that when second work surface 42 is added to the workbench 1, a particular configuration arises at the first pair of troughs 6. In particular, the outermost flange 57 of the first pair of flanges 9 is located in a first trough 58 of the first pair of troughs 6, and the outermost flange 59 of the third pair of flanges 44 is located in a second trough 60 of the first pair of troughs 6. In this configuration the first end 8 of the first work surface 4 abuts against the first end 43 of the second work surface 42. Therefore, it will be appreciated that an advantageous feature of having a pair of parallel troughs is that they can support two adjacent work surfaces simultaneously.

It will also be appreciated from FIG. 6 that the outermost flange 57 of the first pair of flanges 9 is spaced from the first end 8 of the first work surface 4 by half the distance the first pair of flanges 9 are spaced apart from one another. Likewise, the outermost flange 59 of the third pair of flanges 44 is spaced from the first end 43 of the second work surface 42 by half the distance the third pair of flanges 44 are spaced apart from one another. It is this configuration which leads to the first ends 8 and 43 abutting neatly against one another and eliminating any gap between the first work surface 4 and the second work surface 42, and the outermost flanges 57 and 59 fitting into the first pair of troughs 6 when this is the case. The outermost flanges 57 and 59 and effectively form a further temporary pair of flanges. These features are important because they results in a continuous They also lead to stability for the workbench 1, because certain loadings applied to the first work surface 4 or the second work surface 42 in use can be transmitted from one to the other, in order to spread them.

Although it is not shown in the Figures, it will be appreciated that the above described functionality also allows for a modular system of interlocking first work surfaces. In particular, if an additional first work surface 4 and first or second support 2 or 3 is provided, then a workbench can be constructed with three supports 2,3 in a line, and two first work surfaces 4 mounted in the spaces between them. The configuration shown in FIG. 6 can be used at the middle one of the three supports 2,3 with an outermost flange of the pair of flanges at the end of one work surface 4 located in one of the pair of troughs, and an outermost flange of the pair of flanges at the end of the other work surface 4 located in the other of the pair of troughs. It will be appreciated that there is no limit to the number of supports and work surfaces which could be erected in a line in this manner. As the second pair of flanges 14 are spaced apart from the second end 13 by half the distance the second pair of flanges 14 are spaced apart from one another, no gap will exist between first work surfaces arranged alongside one another in this way, for the reasons explained above.

Figure 8:
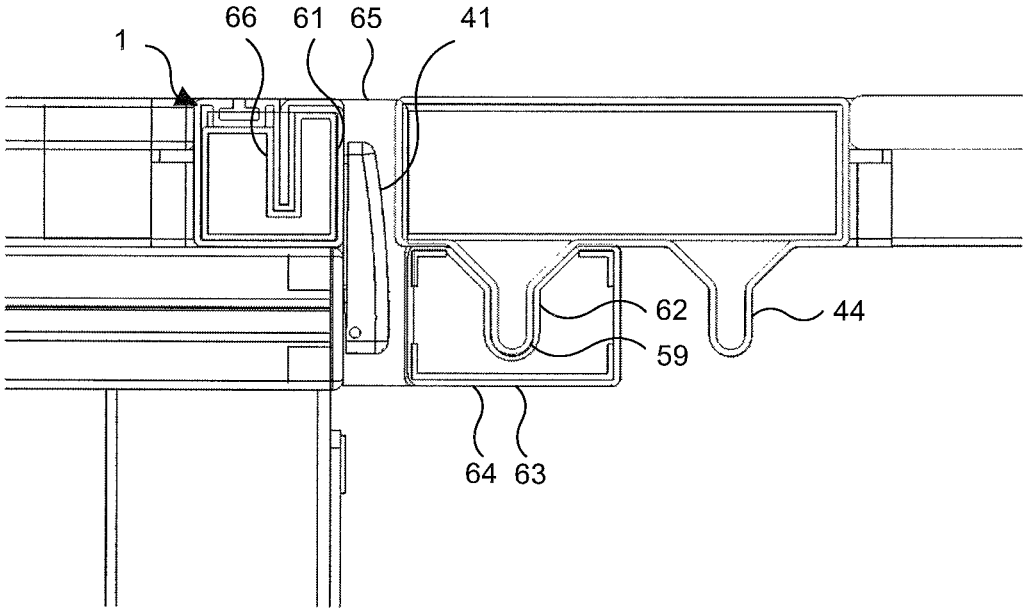
FIG. 8 is a partial cross-sectional end view of the workbench shown in FIG. 7.

Referring now to FIGS. 7 and 8, the first work surface 4 comprises a first edge 61 extending between the first end 8 and the second end 13. The first edge 61 comprises a single elongate trough 62, which is shaped and configured to receive a flange of the same shape as any flange of the first, second or third pairs of flanges 9, 14 or 44. The trough 62 is provided in a member 63 which is releasably mounted to the first edge 61. The member 63 comprises a body portion 64 which defines the trough 62, and a U-shaped latch portion 65 which engages an upwardly facing slot 66 provided adjacent the first edge 61. A tab 40 is provided at each end of the trough 62, so retention clips 41 can be used to secure a flange in the trough 62.

These features allow for an L-shaped a configuration of first or second work surfaces like that shown in FIG. 7. In FIG. 7 the first work surface 4 and second work surface 42 as shown in FIG. 5 are enhanced by having a member 63 mounted to the first edge 61, and then an additional second work surface 42 mounted to it. As shown in FIG. 8, this is achieved by locating the outermost flange 59 of the third pair of flanges 44 of the additional second work surface 42 in the single trough 62.

A second edge 67 of the first work surface 4, as well as first and second edges 68 and 69 of the second work surface 42, are all provided with upwardly facing slots like slot 66, so any configuration of first or second work surfaces 4, 42 can be erected in which an end or an edge of any work surface can be mounted to the end or edge of any other.

Referring back to FIG. 4, the first and second spars 19 and 24 at the top of the first support 5 comprise elongate laterally facing first and second slots 70 and 71 respectively. The identical arrangement is provided at the top of the second support 10.

Figure 9:
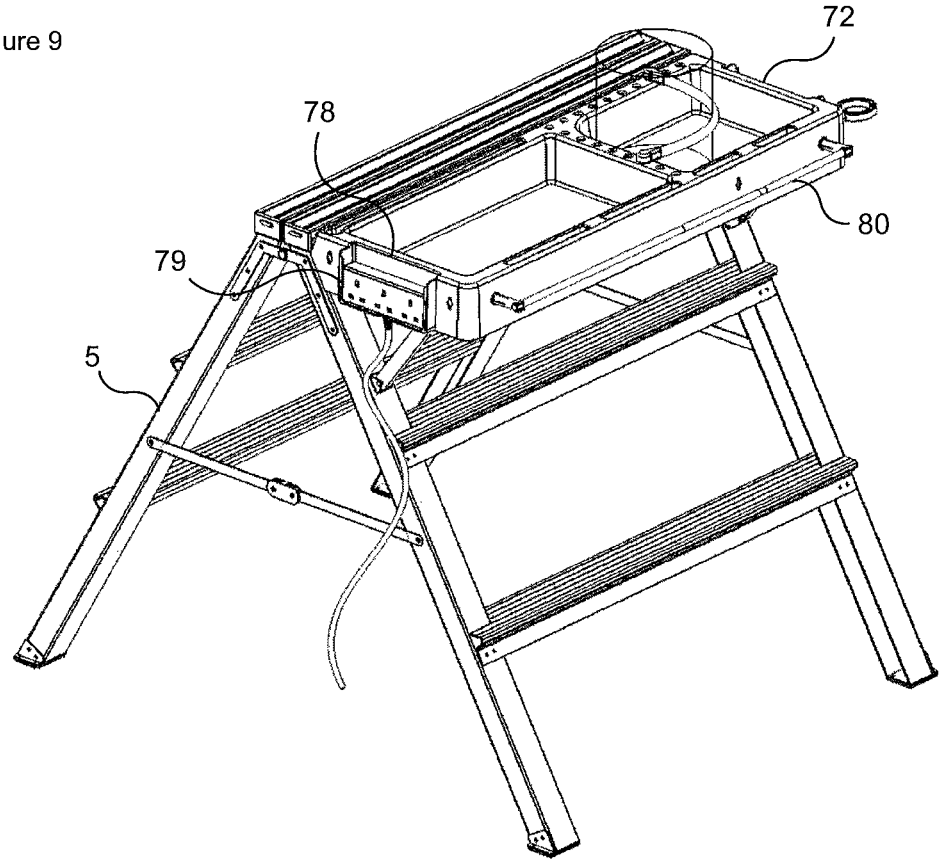
FIG. 9 is a perspective view of a first support of the workbench shown in FIG. 1 in a second configuration.
Figure 10:
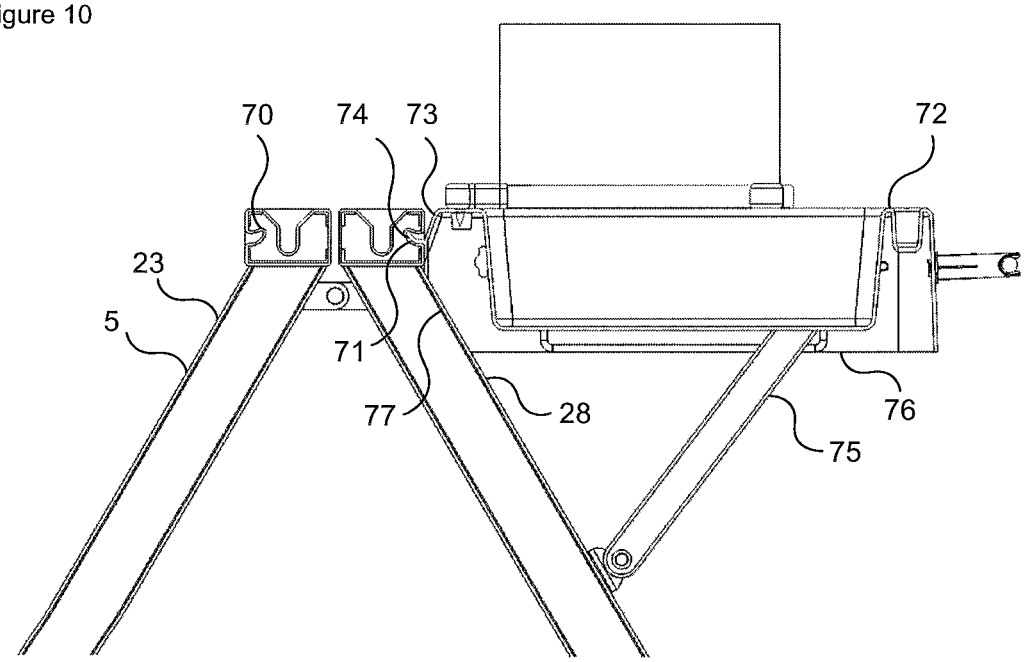
FIG. 10 is a partial cross-sectional end view of the first support shown in FIG. 9.

Referring to FIGS. 9 and 10, the workbench 1 can further comprise a work tray 72, with a first end 73 comprising an elongate key 74, which is shaped and configured to be releasably engagable in the first and second slots 70 and 71. The work tray 72 also comprises support posts 75 extending from an underside 76 thereof, which are releasably connectable to the first leg structure 5 or the second leg structure 10, at a mid-point below an upper end thereof. The first end 73 of work tray 72 also comprises an inclined surface 77 which abuts against the adjacent first arms 22 and 23 or second arms 27 and 28 of the first leg structure 5 or second leg structure 10 in question. These features ensure that when the work tray 72 is fitted to the first leg structure 5 or the second leg structure 6, it is secure.

It will be appreciated that the work tray 72 can be fitted to either side of either the first leg structure 5 or the second leg structure 10, and if so it will be located at the end of the first work surface 4 which the first leg structure 5 or second leg structure 10 is carrying. The work tray 72 provides an additional area where a workman can keep tools or building supplies they may need access to when working. As shown in FIG. 9, the work tray 72 also has a slot 78 to carry electrical plugs 79, and a rail 80 for carrying a roll of material, or cloths and rags.

In use the workbench 1 operates as follows. To erect a single work surface 4, the first leg structure 5 and the second leg structure 10 are arranged in their unfurled positions, with the first arms 22 and 23 angled away from the second arms 27 and 28 as shown in FIG. 3. The first leg structure 5 and the second leg structure 10 are arranged the appropriate distance apart from one another as shown in FIG. 1, and the work surface 4 is lowered thereon. The first pair of flanges 9 is located into the first pair of troughs 6, and the second pair of flanges 14 is located into the second pair of troughs 11. The ends 39 of the flanges of the first pair of flanges 9 can be placed anywhere on the first sections 34 of the troughs of the first pair of troughs 6, and the ends 39 will ride over the first sections 34 until the fourth sections 38 of the flanges are aligned with the second sections 35 of the troughs, and the flanges will drop into position. The same process will occur between the second pair of flanges 14 and the second pair of troughs 11. As each of the first and second pairs of flanges 9 and 14, as well as each of the first and second pairs of troughs 6 and 11, are parallel, each of a pair of flanges will locate simultaneously in the same way in a corresponding pair of troughs. Once the first pair of flanges 9 are located in the first pair of troughs 6, the first A-frame 17 is locked in the unfurled position, because the first pair of troughs 6 cannot be rotated away from one another. Likewise, once the second pair of flanges 14 are located in the second pair of troughs 11, the second A-frame 18 is also locked in the unfurled position for the same reason. The eight retention clips 41 at the opposite ends of the flanges of the first pair of flanges 9 and the second pair of flanges 14 are applied to the eight tabs at the opposite ends of the troughs of the first pair or troughs 6 and the second pair of troughs 11. This locks the work surface 4 to the first leg structure 5 and the second leg structure 10, and it also prevents any axial movement of the various flanges in their corresponding toughs. Thus, any lateral forces applied to the ends 8 and 13 or edges 61 and 67 of the first work surface 4 in use are transmitted to the first leg structure 5 and the second leg structure 10, so the work surface 4 will not move therefrom.

The elongate nature of the four flanges of the first pair of flanges 9 and the second pair of flanges 14, and the fact that there are two in parallel in each case, provides a beneficial way to spread loading applied to the work surface 4 in use which is transmitted to the interface between the work surface 4 and the first leg structure 5 and the second leg structure 10. In particular, any lateral loading applied from the centre of the work surface 4, which would result from weight carried by the work surface 4, or any twisting forces applied to the work surface 4 in relation to the first leg structure 5 or the second leg structure 10, is adequately compensated for by the large area of the various flanges. Such loadings would occur when machines like saws are used. Further, this parallel flange configuration also provides a redundancy should one of the flanges of the first pair of flanges 9 or the second pair of flanges 14 fail under loading in use.

In addition, the workbench 1 shown in FIG. 1 effectively comprises eight legs, in the form of the first arms 22 and 23 and the second arms 27 and 28 of each of the first leg structure 5 and the second leg structure 10. As such, any loading applied to the workbench 1 in use is spread across these components. As such, the workbench 1 shown in FIG. 1 is capable of supporting considerable loads, including a person. Furthermore, each of the first leg structure 5 and the second leg structure 10 is a solid and stable platform in its own right, due to being made up of a pair of spaced apart parallel A-frames, which is also highly resistant to toppling. As such, the workbench 1 as a whole is also highly resistant to toppling, in particular in any direction in which a pair of first arms 22 and 23, or second arms 27 and 28 is splayed outwardly from the work surface 4.

If required the user can apply a machine tool or the like, such as saw 16, to the work surface 4 in any of the known ways.

If a larger working surface is required then additional work surfaces can be added to the work surface 4, as required, as shown in FIGS. 5 and 7. If a longer working surface is required, then a second work surface 42 can be erected next to the first work surface 4, as shown in FIG. 5. The second work surface 43 is arranged in its unfurled position, with the leg structure 48 rotated about hinge 46 until it is perpendicular to the work surface 42. The first support brackets 53 are arranged to extend between the legs 49 and 50 and the second work surface 49, and the second support brackets 54 are arranged to extend between each leg 49 and 50 of the leg structure 48 and the corresponding first arms 22 and 23 of A-frames 17 and 18 of the first leg structure 5.

The first pair of parallel flanges 9 is then arranged with the outermost flange 57 located in the first trough 58 of the first pair of troughs 6. This leaves the second trough 60 free. The outermost flange 59 of the third pair of flanges 44 is then located in a second trough 60, with the first end 43 of the second work surface 42 abutting against the first end 8 of the first work surface 4. Retention clips 41 are used to secure the flanges 57 and 59 in the troughs 58 and 60.

Alternatively, another first work surface can be added to the first work surface 4 instead of a second work surface 42. If so, another first or second leg structure 5 or 10 is also provided, and a workbench is erected with three leg structures 5,10 in a line, and two first work surfaces 4 mounted in the spaces between them. The configuration shown in FIG. 6 is used at the middle one of the three leg structures 5, 10 with an outermost flange of the pair of flanges at the end of one work surface 4 located in one of the pair of troughs, and an outermost flange of the pair of flanges at the end of the other work surface 4 located in the other of the pair of troughs. Again, retention clips 41 are used to secure the flanges in the troughs. It will be appreciated that there is no limit to the number of leg structures and work surfaces which could be erected in a line in this manner.

In another alternative, a second work surface 42 can be added to the first edge 61 or second edge 67 of the first work surface 4. A member 63 is mounted to the first edge 61 or second edge 67, with the U-shaped latch portion 65 located in the upwardly facing slot 66 provided adjacent the first edge 61 or second edge 67. Then, the outermost flange 59 of the third pair of flanges 44 of a second work surface 42 in the unfurled position is located in the trough 62. Retention clips 41 are used to secure the flange 59 in the trough 62. An L-shaped work surface can be erected if second work surfaces 42 are applied in positions adjacent the first end 8 or second end 13, or the first edge 61 or the second edge 67 of the first work surface 4.

Instead of another second work surface 42 being used to create an L-shaped working surface, another first work surface 4 could be used instead, using the same method of mounting to the first edge 61 or the second edge 67 of the first work surface 4 as described above. A leg structure 5,10 would be needed at the second end of this further first work surface 4.

In fact, given that any of ends 8 and 13 or edges 61 and 67 of a first work surface 4, and any first end 43, or edge 68 and 69 of a second work surface 42 can be connected to any other using the methods described above, any complex multi-work surface configuration of first or second work surfaces 4, 42 can be erected as desired.

If a work tray 72 is needed, then it can be added to a free end 8 or 13 of a first work surface 4 of any of the configurations described above. The key 74 is located in the slot 70 or 71, and the support post 75 is employed.

Once the first work surface 4, or combination of first and/or second work surfaces 4, 42, is no longer needed, the components can be collapsed for storage or transportation, by disconnecting them in the reversal of the mounting steps described above, and then collapsing down the first leg structures 5, second leg structures 10 and second work surfaces 42. All these parts fold flat, so are very easy to store or transport.

The above described embodiment can be altered without departing from the scope of claim 1. For example in alternative embodiments (not shown) the elongate troughs have other cross-sectional shapes, including squares, rectangles and triangles. In other alternative examples (not shown) the first work surface and second work surface can be rectangular rather than square.

In addition, in another alternative embodiment (not show) the first pair of flanges are provided on the upper end of the first support and the first pair of troughs are provided on the first end of the first work surface. This is the opposite arrangement to as shown in workbench 1, but it functions just as effectively. Further, in other alternative embodiments (now shown) the second pair of flanges and the second pair of troughs are oriented the opposite way to as in work bench 1. In this embodiment the first end of the second work surface comprises a third pair of troughs rather than flanges and the first edge of the first work surface comprises a single elongate flange rather than a trough.

Therefore, the present invention provides a collapsible workbench which is strong, stable and resistant to collapse when unfurled. The parallel flanges and troughs arrangement provides particular strength to the interface between the work surface and its supports. The area of the interface is large, there is in-built redundancy, and the shape of the flanges and troughs allows ready engagement. These features also provide the means for multiple work surfaces to be arranged in a line with no gaps between them. Further, this interface system also allows work surfaces to be arranged normal to one another if desired. The additional work tray feature provides yet further useful advantages.

The invention claimed is:

1. A workbench comprising:

a first support;

a second support; and a first work surface member, wherein said first support comprises a leg structure with an upper end;

wherein said first work surface member comprises a first end comprising a first end surface portion and an underside surface portion wherein said first end surface portion is disposed perpendicular to said underside surface portion;

wherein said upper end of said leg structure and said underside surface portion comprise a connection releasably connecting said upper end of said leg structure and said first end of said work surface member together;

wherein said connection comprises a first pair of parallel elongate troughs provided upon one of either said upper end of said leg structure or upon said underside surface portion adjacent to said first end surface portion, a first pair of parallel elongate flanges are provided upon the other one of said upper end of said leg structure or upon said underside surface portion adjacent to said first end surface portion;

wherein said first pair of said parallel elongate troughs and said first pair of said parallel elongate flanges are both disposed parallel to said first end surface portion when said upper end of said leg structure and said underside surface portion of are connected together;

wherein said first pair of parallel elongate flanges face in a first direction and said first pair of parallel elongate troughs face in a second opposite direction when said upper end of said leg structure and said underside surface portion are connected together; and wherein said first pair of parallel elongate flanges are shaped and configured to be releasably engageable within said first pair of parallel elongate troughs.

2. A workbench as claimed in claim 1 wherein said upper end of said first support comprises said first pair of troughs and said first end of said first work surface member comprises said first pair of flanges.

3. A workbench as claimed in claim 2 wherein said second support comprises a leg structure provided with a second pair of parallel elongate troughs at an upper end thereof, wherein said first work surface member comprises a second end comprising a second pair of parallel elongate flanges, and wherein said second pair of flanges is shaped and configured so as to be releasably engageable within said second pair of troughs.

4. A workbench as claimed in claim 3 wherein each one of said troughs of each one of said first and second pairs of troughs comprises a cross-sectional shape comprising a receiving opening, a first section, a second section, and a base, wherein said first section tapers inwardly from said receiving opening to said second section, in which said second section has a constant width from said first section to said base, wherein said base comprises a rounded shape, and wherein each one of said flanges of each one of said first and second pairs of flanges comprises a cross-sectional configuration comprising a third section, a fourth section, and an end which corresponds in shape to said first section, said second section, and said base respectively of each one of said troughs of each one of said first and second pairs of troughs.

5. A workbench as claimed in claim 3 wherein said first support is provided with a retention member at each end of each one of said troughs of said first pair of troughs, wherein said second support is provided with a retention member at each end of each one of said troughs of said second pair of troughs, wherein said first work surface member comprises a retention clip at each end of each one of said flanges of each of each one of said first and second pairs of flanges, and wherein each one of said retention clips releasably retains one of said retention members.

6. A workbench as claimed in claim 3 wherein each one of said leg structures comprises a pair of parallel collapsible A-frames with a first spar extending between tops of corresponding first arms of said pair of A-frames, and a second spar extending between tops of corresponding second arms of said pair of A-frames, said first arms being hinged to said second arms, and wherein said first and second pairs of troughs are respectively mounted upon said first and second spars.

7. A workbench as claimed in claim 3 wherein said workbench comprises a second work surface member comprising a first end comprising a third pair of parallel elongate flanges, wherein said third pair of flanges are shaped and configured to be releasably engageable within said first pair of troughs, wherein said second work surface member comprises a second end comprising a hinge, wherein said workbench comprises a third support, and wherein said third support comprises a leg structure rotatably connected to said hinge.

8. A workbench as claimed in claim 7 wherein said third pair of flanges are spaced from said first end of said second work surface member by a distance which is substantially one half the distance said third pair of flanges are spaced from each other.

9. A workbench as claimed in claim 3 wherein said first work surface member comprises a first edge extending between said first end and said second end, wherein said first edge comprises an elongate trough shaped and configured to receive a flange of the same shape as any flange of said first or second pairs of flanges.

10. A workbench as claimed in claim 3 further comprising a work tray, wherein said first support comprises first and second elongate laterally facing slots at said upper end thereof, wherein said first elongate slot faces a first direction and said second elongate slot faces a second direction opposite to said first direction in which said elongate slot faces, and wherein said second support comprises third and fourth elongate laterally facing slots at said upper end thereof, wherein said third elongate slot faces a third direction and said fourth elongate slot faces a fourth direction opposite to said third direction in which said third elongate slot faces, and wherein said work tray comprises a first end comprising an elongate key which is shaped and configured so as to be releasably engageable in any of said first, second, third, or fourth elongate slots.

11. A workbench as claimed in claim 3 wherein said first pair of flanges are spaced from said first end by a distance which is substantially one half the distance said first pair of flanges are spaced from each other.

12. A workbench as claimed in claim 11 wherein which said second pair of flanges are spaced from said second end by a distance which is substantially one half the distance said second pair of flanges are spaced from each other.

13. A workbench as claimed in claim 1 wherein said first work surface member comprises a second end comprising a hinge, and wherein said second support comprises a leg structure rotatably connected to said hinge.

14. A workbench as claimed in claim 1 further comprising a work tray, wherein said first support comprises a first elongate laterally facing slot at said upper end thereof, and wherein said work tray comprises a first end comprising an elongate key which is shaped and configured so as to be releasably engageable in said elongate slot of said first support.

15. A workbench as claimed in claim 14 wherein said first support comprises a second elongate laterally facing slot at said upper end thereof, wherein said first elongate slot faces a first direction and said second elongate slot faces a second direction opposite to said first direction in which said elongate slot faces.

16. A workbench as claimed in claim 14 wherein which said work tray comprises a support post extending from an underside thereof, wherein said support post is releasably connectable to said first or second support at a mid-point below said upper end thereof.

* * * * *